US005494212A

United States Patent [19]

Owen

[11] Patent Number: 5,494,212

[45] Date of Patent: Feb. 27, 1996

[54] RAIL-TIE FASTENING METHOD FOR CONCRETE TIE

[75] Inventor: S. Hudson Owen, Marshfield, Wis.

[73] Assignee: Kerr-McGhee Chemical Corporation, Oklahoma City, Okla.

[21] Appl. No.: 451,783

[22] Filed: May 26, 1995

Related U.S. Application Data

[62] Division of Ser. No. 273,063, Jul. 11, 1994.

[51] Int. Cl.[6] ..... E01B 9/42; E01B 9/48

[52] U.S. Cl. ..... 238/265; 238/270; 238/283; 238/349; 238/354; 238/365

[58] Field of Search ..... 238/265, 270, 238/283, 287, 338, 349, 354, 361, 365

[56] References Cited

U.S. PATENT DOCUMENTS

| | | | |
|---|---|---|---|
| 32,894 | 3/1989 | Gragnami . | |
| 2,557,271 | 6/1951 | Fulton | 238/338 |
| 3,147,921 | 9/1964 | Delcroix | 238/310 |
| 3,282,506 | 11/1966 | Holstein | 238/287 |
| 3,338,520 | 8/1967 | Dinger | 238/349 |
| 3,442,452 | 5/1969 | Harmsen | 238/265 |
| 3,519,205 | 7/1970 | Monclin et al. | 238/338 |
| 3,558,060 | 1/1971 | Crespo | 238/349 |
| 3,576,293 | 4/1971 | Landis | 238/287 |
| 3,581,990 | 6/1971 | Kirik | 238/283 |
| 3,731,875 | 5/1973 | Burwell | 238/346 |
| 3,784,097 | 1/1974 | Landis | 238/310 |
| 3,826,424 | 7/1974 | McClung et al. | 238/264 |
| 3,834,620 | 9/1974 | Bartlett | 238/287 |
| 3,858,804 | 1/1975 | Hixson | 238/264 |
| 3,863,329 | 2/1975 | Bartlett | 29/428 |
| 3,888,414 | 6/1975 | Duchemin | 238/349 |
| 3,904,113 | 9/1975 | Molyneux | 238/264 |
| 3,957,201 | 5/1976 | Johnson et al. | 238/298 |
| 3,987,262 | 10/1976 | Robbins | 238/287 |
| 4,026,466 | 5/1977 | Duchemin | 238/349 |
| 4,141,500 | 2/1979 | Gragnani | 238/304 |
| 4,155,507 | 5/1979 | Chierici et al. | 238/287 |
| 4,204,660 | 5/1980 | Feuillade | 249/86 |
| 4,216,904 | 8/1980 | Vivion | 238/338 |
| 4,267,970 | 5/1981 | Lubbers | 238/310 |
| 4,275,832 | 6/1981 | Kenyon | 238/310 |
| 4,310,120 | 1/1982 | Matsuo et al. | 238/349 |
| 4,316,578 | 2/1982 | Reynolds et al. | 238/283 |
| 4,349,150 | 9/1982 | Lubbers | 238/265 |
| 4,349,151 | 9/1982 | Schumaker | 238/349 |
| 4,379,521 | 4/1983 | Young et al. | 238/349 |
| 4,489,885 | 12/1984 | Bryan | 238/349 |
| 4,494,695 | 1/1985 | Sonneville | 238/265 |
| 4,569,478 | 2/1986 | Bryan | 238/349 |
| 4,572,432 | 2/1986 | Moehren | 238/307 R |
| 4,583,685 | 4/1986 | Robb et al. | 238/54 |
| 4,588,126 | 5/1986 | Foulart | 238/310 |
| 4,651,924 | 3/1987 | Javelle | 238/117 |
| 4,688,719 | 4/1987 | Young et al. | 238/351 |
| 4,715,533 | 12/1987 | Buckabee et al. | 238/283 |
| 4,718,603 | 1/1988 | Elsenmann et al. | 238/106 |
| 4,723,706 | 2/1988 | Ortwein | 238/283 |
| 4,850,770 | 7/1989 | Millar et al. | 410/10 |
| 4,874,128 | 10/1989 | Owen | 238/355 |
| 4,921,167 | 5/1990 | Staggl et al. | 238/126 |
| 4,921,168 | 5/1990 | Heim | 238/287 |
| 4,923,118 | 5/1990 | Goossens | 238/283 |

(List continued on next page.)

*Primary Examiner*—Robert J. Oberleitner
*Assistant Examiner*—S. Joseph Morano
*Attorney, Agent, or Firm*—Herbert M. Hanegan; J. Rodgers Lunsford, III; Clark G. Sullivan

[57] ABSTRACT

A rail-tie fastening assembly for fastening a rail to a concrete tie comprising a rail seat assembly and a rail anchor. The rail seat assembly includes a rail seat basin and a rail seat wherein the rail seat is disposed in the rail seat basin and bonded thereto with an elastomeric material having a void formed therein between the bottom of the rail seat and the bottom of the rail seat basin so as to produce a shear spring which transfers applied vertical load from the rail to the tie. The rail seat assembly is embedded in the tie and the rail anchor is adapted to engage a portion of the rail and to interlock with the rail seat assembly so as to cooperate with the rail seat assembly to fasten the rail to the tie.

12 Claims, 7 Drawing Sheets

U.S. PATENT DOCUMENTS

| | | | |
|---|---|---|---|
| 4,946,099 | 8/1990 | Bratchell | 238/264 |
| 4,988,040 | 1/1991 | Keusch | 238/349 |
| 5,078,319 | 1/1992 | Owen et al. | 238/355 |
| 5,083,706 | 1/1992 | Bratchell | 238/265 |
| 5,110,046 | 5/1992 | Young | 238/283 |
| 5,158,414 | 10/1992 | Kais et al. | 238/292 |
| 5,160,084 | 11/1992 | Owen et al. | 238/310 |
| 5,165,599 | 11/1992 | Owen et al. | 238/355 |
| 5,203,502 | 4/1993 | Young | 238/283 |
| 5,221,044 | 6/1993 | Guins | 238/349 |
| 5,249,743 | 10/1993 | Leingang et al. | 238/283 |

RAIL-TIE FASTENING METHOD FOR CONCRETE TIE

This is a division of application Ser. No. 08/273,063, filed Jul. 11, 1994, pending.

BACKGROUND OF THE INVENTION

1. Field of the Invention

The present invention relates generally to rail fasteners, and more particularly, but not by way of limitation, to an improved rail tie fastening assembly for fastening a rail to a concrete tie and effectively transferring applied loads from the rail to the tie.

2. Brief Description of Related Art

Pretensioned, prestressed concrete railroad ties have evolved since the early 1940's into a proven mechanism to attach railroad rails together, maintain track gauge, and transfer wheel loads to the ground. The base material of these ties is Portland cement concrete reinforced with high strength steel wires which are pretensioned prior to casting to maintain the concrete in compression and thus prevent cracking. The high strength concrete used (8,000 psi or greater ultimate compressive strength) is a stiff, brittle material. Metal fasteners, designed to hold the steel rail to the concrete tie, are part of the mechanism used to transfer applied wheel loads to the ballast.

Presently, two types of fasteners are generally used to fasten rails to concrete ties. The first type of fastener is a positive hold down device which can take a variety of forms such as screws or bolts used together with some form of flanged clip to hold the rail base flange in contact with the tie. This type of fastener is rigid and thus prone to fatigue failure in service, and therefore, is not commonly employed today.

The second type of fastener is in the form of a spring fastener, also used to hold the rail flange in contact with the tie, but designed to reduce fatigue from applied loads by flexing. In the spring type fastener, two iron or steel shoulders are embedded in the concrete tie at each rail seat during casting and serve to hold the rails in gauge and to anchor the spring clip which in turn holds the rail flange down. These spring clips are designed to apply a known vertical force to the rail flange to resist rail uplift between wheel passes and to transfer longitudinal forces from temperature change or train acceleration/deceleration to the tie and into the ground.

In conjunction with the fastener, an elastomeric pad approximately six inches square and one-quarter inch thick is installed between rail and the top of the tie at the seat to accommodate the differences in surface form. If the rail flange were to bear directly upon the concrete tie surface, the steel would soon wear into the top of the concrete. Although the tie is cast in a steel mold, the seat surface does not conform exactly with the rail flange bottom resulting in the potential for point loading and uneven vertical force transfer.

These pads also perform two additional functions. First, because the rail is clamped tightly to the tie by spring clips, the pad, which has a higher coefficient of friction than steel on steel, helps transfer longitudinal forces along the rail into the tie and ballast. Second, and more important, the pads serve to attenuate shock loads applied to the rail by flat spots on passing steel wheels. Shock loads from wheel flats may be two to four times the amplitude of normal wheel loads, and of very short duration, typically about 15 milliseconds. These shock loads tend to fracture the concrete tie if not properly attenuated.

A number of problems have been encountered with the spring type positive retention fastener. The first problem is pad retention. Pad retention is concerned with holding the pad in place under the rail between the rail flange and the tie when the rail is flexed with applied wheel loads. Various shapes have been used to try to keep the pad from working out by retaining it mechanically. This has been only moderately successful, particularly on curved tracks which is the principal location of concrete ties in the United States. Alternatively, pads of varying hardness have been used. However, pads resilient enough to attenuate shock loads, tend to work out from between the rail and the tie under normal wheel pass cycles. Harder pads do not satisfactorily attenuate the shocks.

Another solution to unwanted pad movement has been to adhere the pad to the concrete tie surface with adhesive. This holds the pad in place, but makes replacement difficult when the top surface of the pad wears out. Also, applying an adhesive in the field to a wet, dirty tie surface presents problems with the quality of the adhesion.

Another problem encountered with the use of shock pads has been rail seat abrasion. Dirt and grit from the field tend to work between the pads and concrete tie surface. Sanders on locomotive wheels, used for traction enhancement, also work sand under the pads. When water supplied by rain is applied to this mix, a grinding compound is formed which works to abrade the concrete surface under passing wheel loads. Adhered seat pads help to alleviate this problem but have the same down side of field replacement when worn. Various metal/elastomer pad combinations have been tried with some success to get rid of rail seat abrasion, but tend to be expensive, particularly when field applied.

Finally, tie lift caused by rail uplift between wheels has been a problem. Tie lift is inherent to all positive fixation fasteners, both screw and spring type. In order for the fastener to work, the rail flange must be held tightly to the tie surface. Since a rail is a continuous beam on multiple flexible supports, it deflects downward under the passing wheel, and the rail between wheels deflects upward from its normal or rest position. The uplift force of the rail is often greater than the weight to the rail/tie assembly. Therefore, with the positive fixation fastener, the tie also is lifted from the surface of the road bed between each wheel set and then forced back onto the ground by the next wheel. This repetitive tamping action quickly damages the roadbed ballast.

It is the resolution of the above mentioned problems that the present invention is directed.

DETAILED DESCRIPTION

Figure 1:
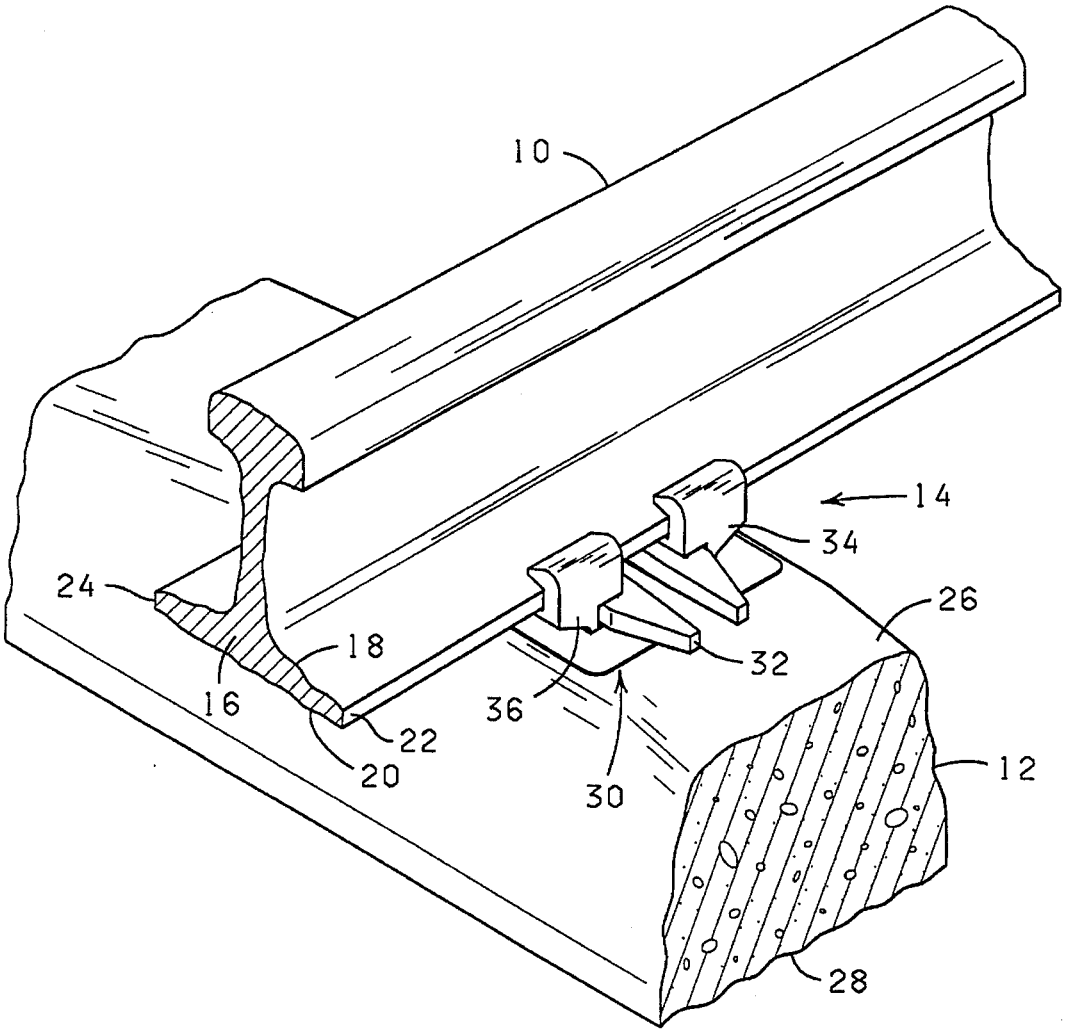
FIG. 1 is a perspective view of a section of a rail fastened to a concrete tie with a rail-tie fastening assembly constructed in accordance with the present invention.

Referring now to the drawings, and more particularly to FIG. 1, shown is a portion of a rail 10 fastened to support structure such as a concrete tie 12 with a rail-tie fastening assembly 14 constructed in accordance with the present invention. The rail 10 has a rail flange 16 characterized as having an upper surface 18, a lower surface 20, a first side 22 and a second side 24. The tie 12 is supported by a ballast (not shown) which is typically gravel or broken stone. The tie 12 has an upper surface 26 and a lower surface 28. The rail fastening assembly 14 includes a rail seat assembly 30 embedded in the tie 12 and a rail anchor 32 which cooperates with the rail seat assembly to fasten the rail 10 to the tie 12.

The use of concrete ties is increasing around the world because of their durability and thus longer life span relative to wood ties. The effects of heavier wheel loads, higher train speeds, increased train frequency, weather and other adverse track conditions reduce the life of wooden ties, particularly on curves, where lateral forces from the rail car wheels tend to push the rails apart and thus impart considerable stress on relatively soft and flexible wood ties. The utilization of concrete ties eliminates many of the problems encountered with the use of wood ties. However, because concrete ties are rather stiff and brittle, their use presents a different set of design problems.

As discussed above, elastomeric pads have been employed between the rail and the concrete tie to accommodate the differences in surface form between the rail and the tie, to facilitate the transfer of lateral and longitudinal forces along the rail into the tie and ballast, and to attenuate vertical shock loads applied to the rail. The shock loads, which are primarily produced by flat spots on steel wheels passing along the rail, can fracture the concrete tie if not properly dampened.

As further discussed above, several problems have been encountered with the use of elastomeric pads; one being the retention of the pad between the rail and the tie and another being the abrasion of the concrete surface as a result of dirt and sand migrating under the pad. The present invention solves the problems associated with the use of shock pads by eliminating the shock pad from the rail-tie fastening assembly 14, while at the same time allowing for the attenuated transfer of vertical, lateral and longitudinal loads from the rail to the tie.

Figure 2:
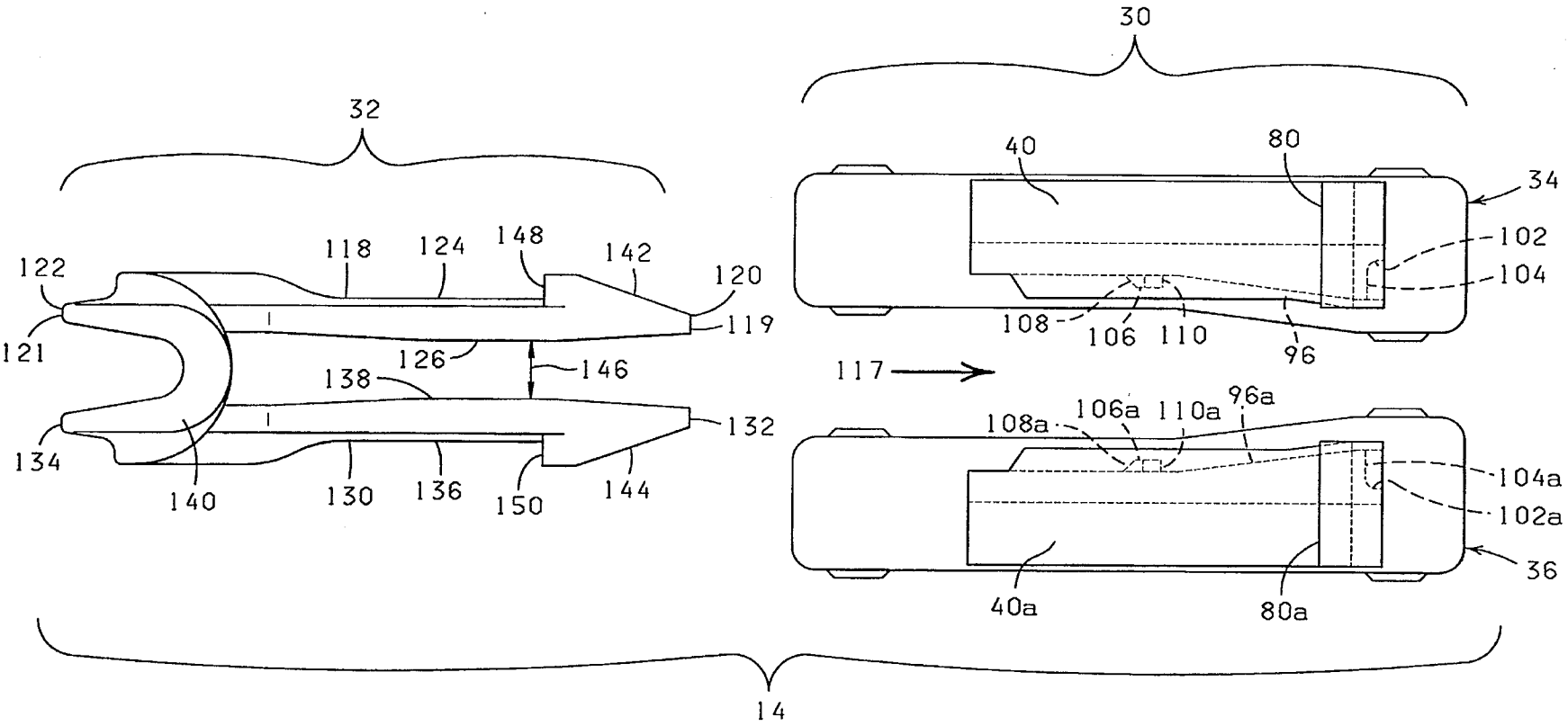
FIG. 2 is a top view of the rail-tie fastening assembly in an unassembled position.
Figure 4:
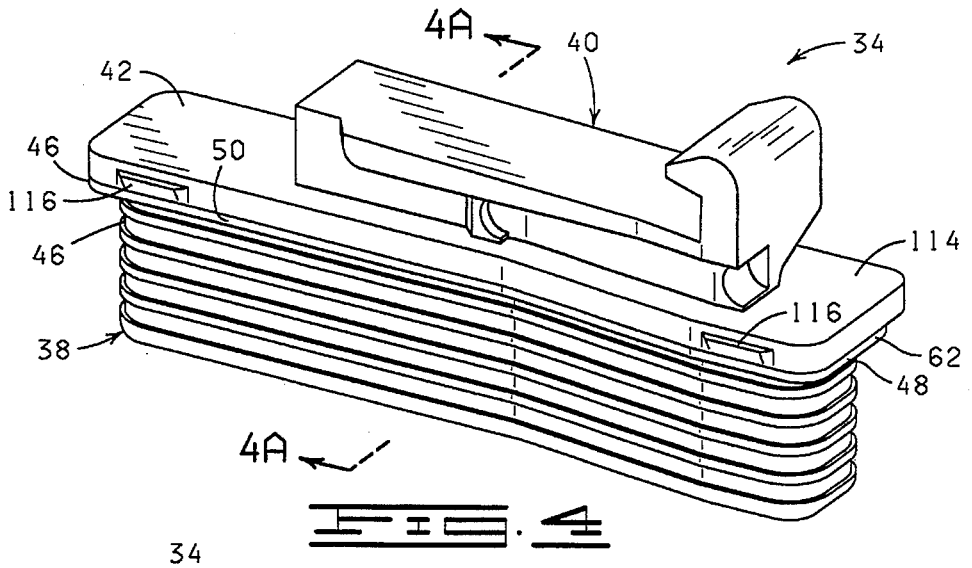
FIG. 4 is a perspective view of a rail seat subassembly of the rail-tie fastening assembly of FIGS. 2 and 3.
Figure 4A:
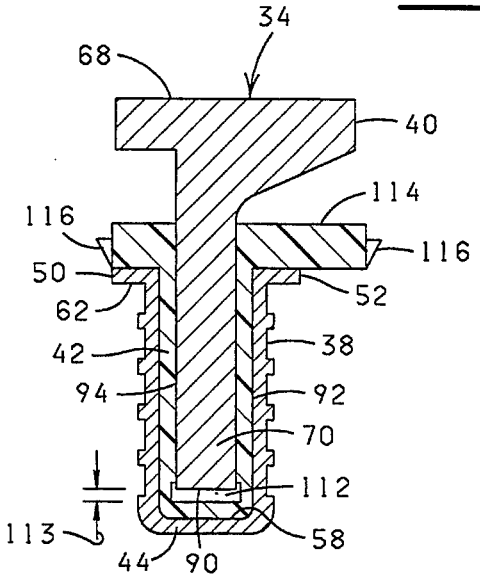
FIG. 4A is a sectional view taken at 4A—4A in FIG. 4.
Figure 5:
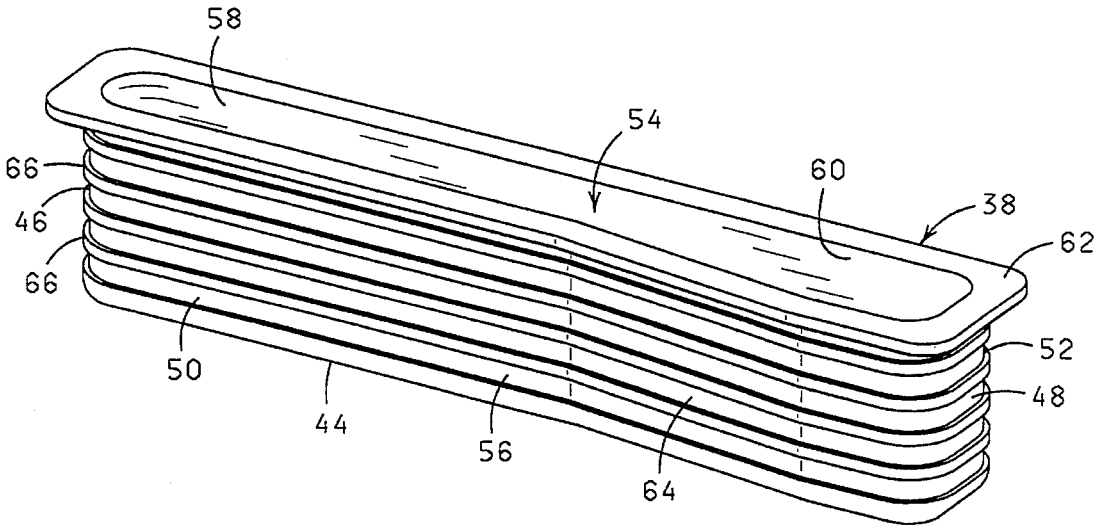
FIG. 5 is a perspective view of a rail seat basin.

FIG. 2 shows a top view of the rail-tie fastening assembly 14 which includes the rail seat assembly 30 and the rail anchor 32. In this particular embodiment of the present invention, the rail seat assembly 30 includes a first rail seat subassembly 34 and a second rail seat subassembly 36. The first and second rail seat subassemblies 34, 36 are identical in construction with the exception that the second rail seat subassembly 36 is a mirror image of the first rail seat subassembly 34. Therefore, only the first rail seat subassembly 34 will be described in detail below in reference to FIGS. 4–6. The first rail seat subassembly 34 includes a rail seat basin 38 and a rail seat 40 bonded to the rail seat basin 38 with an elastomeric material 42 (FIGS. 4 and 4A). The rail seat basin 38 is adapted to be embedded in the concrete tie 12 and to receive the rail seat 40 in a manner to be described below. As best shown in FIG. 5, the rail seat basin 38 is characterized as an open container which includes a bottom end 44, a first end 46, a second end 48, a first side 50, a second side 52, all which cooperate to define a rail seat receiving cavity 54. The rail seat basin 38 further has an outer side 56, an inner side 58, an upper opening 60 providing access to the rail receiving cavity 54, and a rim 62 extending about the upper opening 60.

The rail seat receiving basin 38 may be constructed of any suitable material possessing sufficient shear and tensile strength to transfer operational loads from the rail 10 to the tie 12. These materials include ductile or gray iron, steel, die cast zinc, and various forms of plastics. A preferred material, however, is a die cast aluminum/zinc alloy.

As shown in FIG. 5, the first side 50 of the rail basin 38 is provided with a tapered or angled segment 64 generally near the second end 48 of the rail seat basin 38 which corresponds to a similar portion on the rail seat as will be described hereinbelow. To enhance the union between the rail seat basin 38 and the concrete tie 12 when the rail seat basin 38 is embedded therein, the rail seat basin 38 is provided with a plurality of spaced-apart horizontal ridges 66 extending about the outer side 56 along the first and second ends 46, 48 and the first and second sides 50, 52. Further, the ridges 66 cooperate to transfer vertical loads in compression and shear at the rail seat basin/concrete interface.

Figure 6:
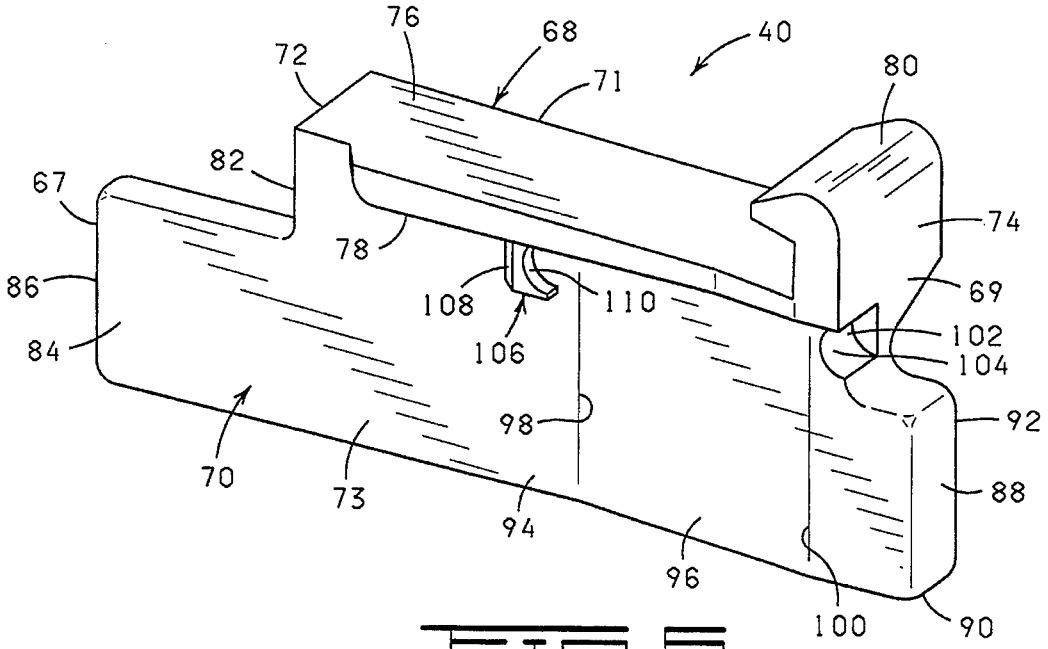
FIG. 6 is a perspective view of a rail seat.

Referring now to FIG. 6, the rail seat 40 as defined as having a first end 67, a second end 69, a first side 71 and a second side 73 and as including a plate portion 68 and a spade portion 70; the spade portion 70 extending downwardly from the plate portion 68. The rail seat 40 can be constructed of any suitable material such as steel, gray iron, or various plastics, but a preferred material of construction is ductile cast iron.

Figure 7:
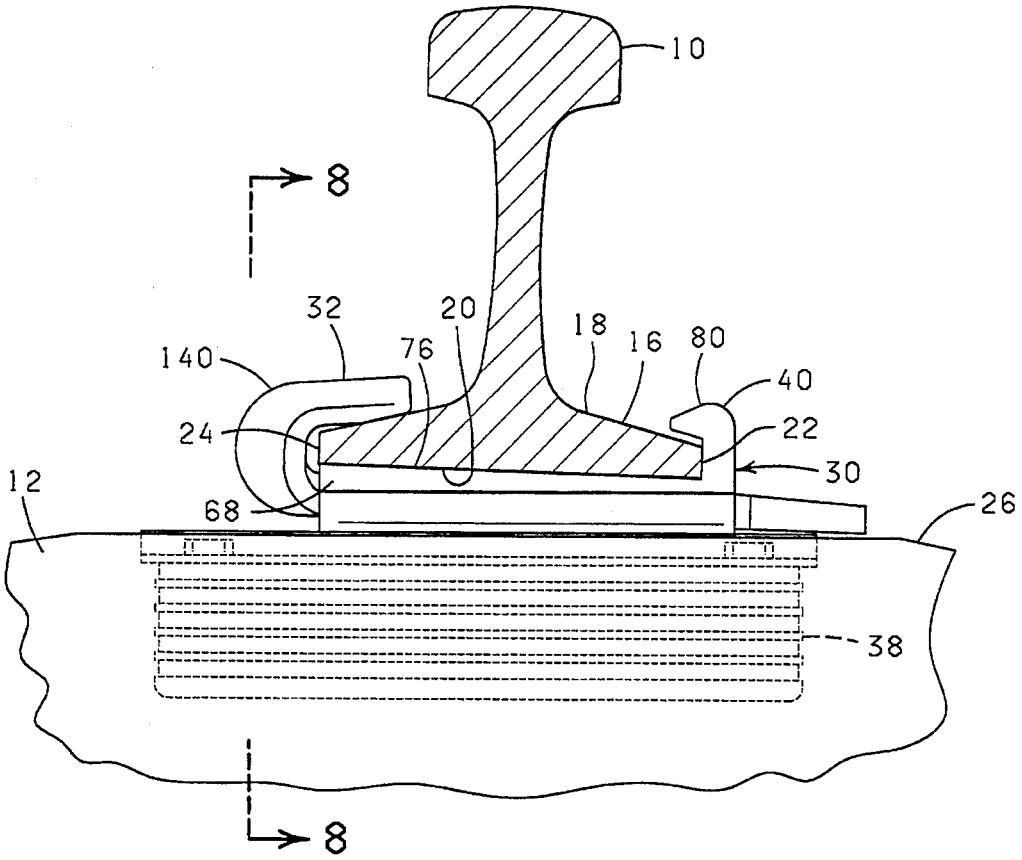
FIG. 7 is a partially cross sectional, side view of the rail-tie fastening assembly of the present invention in an assembled position about a rail.

The plate portion 68 has a first end 72, a second end 74, an upper surface 76, and a lower surface 78. As best illustrated in FIG. 7, the upper surface 76 of the plate portion 68 is adapted to receive the lower portion 20 of the rail flange 16 such that the interface between the rail 10 and plate portion 68 is metal to metal when the rail seat 40 is formed from the preferred material. A hook portion 80 is formed on the second end 74 of the plate portion 68 so as to extend upwardly relative to the upper surface 76 of the plate portion 68. As FIG. 7 illustrates, the hook portion 80 is shaped and adapted to engage the second side 24 of the rail flange 16 and to extend over a portion of the upper surface 18 of the rail flange 16 generally near the second side 24 of the rail flange 16. More particularly, the hook portion 80 is shaped so that a portion of the hook portion 80 will extend over a portion of the upper surface 18 of the rail flange 16 and be spaced from the upper surface 18 of the rail flange 16 so as to permit limited vertical movement of the rail 10 relative to the rail seat 40 when the rail 10 is fastened to the tie 12 by the rail-tie fastening assembly 14 as will be discussed further hereinbelow.

The spade portion 70 extends downwardly from the lower surface 78 of the plate portion 68. The spade portion 70 includes an upper portion 82, a lower portion 84, a first end 86, a second end 88, a bottom end 90, a first side 92, and a second side 94. The lower portion 84 is elongated relative to the upper portion 82 to resist the overturning moment produced in both positive and negative directions in conjunction with an applied lateral load on the rail 10 when the rail 10 is secured against the rail seat subassembly 34. The first and second sides 92, 94 are relatively broad, flat surfaces such that longitudinal loads applied to the rail 10 are evenly distributed to the tie 12.

The spade portion 70 is further provided with a tapered surface portion 96 on the second side 94 thereof generally near the second end 88 of the spade portion 70. The tapered surface portion 96 has a first end 98 and a second end 100. It will be understood that the rail seat basin 38 (FIGS. 4 and 5) is configured to substantially correspond to the configuration of the spade portion 70 such that the spade portion 70 is uniformly spaced a predetermined distance from the inner side 58 of the rail seat basin 38 when disposed therein. The function of this spacing will be explained in detail below.

A recess 102 is formed in the upper portion 82 of the spade portion 70 on the second end 88 thereof so as to be in communication with the second side 94 of the spade portion 70. The recess 102 is partially defined by a seat surface 104.

A tab member 106 is formed on the second side 94 of the spade portion 70 generally near the first end 98 of the tapered surface portion 96. The tab member 106 is provided with a tapered surface 108 and a seat surface 110 which is similar in configuration to the seat surface 104 of the recess 102.

In assembly, as shown in FIGS. 4 and 4A, the elongated lower portion 84 of the spade portion 70 of the rail seat 40 is substantially disposed within the rail seat receiving cavity 54 of the rail seat basin 38 and aligned therein such that the spade portion 70 is uniformly spaced from the inner side 58 of the rail seat basin 38. The spade portion 70 is bonded to the inner side 58 of the rail seat basin 38 with the elastomeric material 42 such that the spade portion 70 remains uniformly spaced from the inner side 58 of the rail seat basin 38.

The elastomeric material 42 functions as a shear spring so as to transfer applied vertical and lateral load on the rail to the tie. Any suitable elastomeric material can be used which possesses the characteristics of being resistant to fatigue, stable between −20° F. and +140° F., resistant to ultraviolet light and ozone, and capable of bonding the rail seat 40 to the rail seat basin 38. A preferred material is a castable polyurethane. The polyurethane is preferably polyether-based diphenylmethane diisocyanate terminated liquid prepolymer cured with 1,4-butanediol wherein the polyether is preferably poly tetra methylene ether glycol.

To permit the rail seat 40 to move vertically downward relative to the rail seat basin 38 and to allow the elastomeric material 42 disposed adjacent the first and second ends 86, 88 and the first and second sides 92, 94 of the spade portion 70 to deflect when a load is applied to the plate portion 68, the elastomeric material 42 is provided with a void 112 between the bottom end 90 of the spade portion 70 and the bottom end 44 of the rail seat basin 38 along the inner side 58 of the rail seat basin 38 (FIG. 4A). The void 112 is formed in the elastomeric material 42 so as to be encapsulated so that air present in the void 112 after formation of the void 112 remains therein and cooperates with the elastomeric material 42 to cause the rail seat 68 to move in an up and down direction in response to loading and unloading of the rail seat 40. The void 112 is further formed to have a predetermined depth 113 so that if an overload occurs on the rail seat 40, the descending spade portion 70 fills the void 112 and engages the elastomeric material 42 disposed along the bottom end 44 of the rail seat basin 38. The elastomeric material 42 along the bottom end 44 of the rail seat basin 38 thus serves as a stop member. By preventing further deflection than that which is permitted by the elastomeric material 42 on the bottom end 44 of the rail seat basin 38, the elastomeric material 42 is prevented from being stressed beyond design limits and thus prevented from rupturing.

The void 112 is preferably formed by adhering a polystyrene foam plug (not shown) on the bottom end 90 of the spade portion 70 of the rail seat 40 prior to inserting the spade portion 70 into the rail seat receiving cavity 54. The rail seat 40 with the polystyrene foam plug (not shown) attached thereto is then disposed into the rail seat receiving cavity 54 which is provided with a measured amount of the elastomeric material 42 in a liquid state. The elastomeric material 42 is then molded and cured. During the curing process, the rail seat subassembly 34 is heated to a sufficient temperature to cause the polystyrene plug to melt and thus leave the void 112 with only a thin film of polystyrene remaining on the surfaces surrounding the void 112.

The amount of elastomeric material 42 disposed in the rail seat basin 38 is sufficient so that when the rail seat 40 is disposed in the elastomeric material 42, a portion of the elastomeric material 42 is displaced upwardly and outwardly from the rail seat receiving cavity 54 to form a tie mold plug 114. The tie mold plug 114 is formed so as to be aligned with the rim 62 of the rail seat basin 38 along the first end 46, the first side 50 and the second end 48. The tie mold plug 114 is extended laterally over the rim 62 along the second side 52 of the rail seat basin 38 so that the tie mold plug 114 is wider in profile than the plate portion 68 of the rail seat 40 to allow the finished tie 12 to be extracted from the tie mold after casting. A plurality of lugs 116 are formed along the edge of the tie mold plug 114 as substantially shown to facilitate the vertical register of the rail seat subassembly 34 in a tie mold (not shown) as will be described further below.

The equation for calculating deflection under load for a shear spring is:

$$D=WT/AG_s$$

where:

D=Deflection parallel to load

W=Applied load

T=Thickness of elastomeric material

A=Area of elastomeric material parallel to load $G_s$=Shear modules for elastomeric material Thus, by taking into consideration the desired amount of deflection under load, the typical load applied by a passing train, and the preferred elastomeric material, as well as considering overturning moments produced by lateral loads, a preferred configuration for the spade portion 70 can be fashioned and the thickness of the elastomeric material 42 calculated. It will be understood that the spade portion 70 can be configured in a variety of different shapes and sizes and that the rail seat 40 depicted in the drawings is only a preferred configuration when desiring not more than 1/32 inch of vertical deflection of the rail seat 40 relative to the rail seat basin 38 and not more ¼ inch rail head rotation under the current specifications of the railroad industry for vertical and lateral wheel loads.

Figure 8:
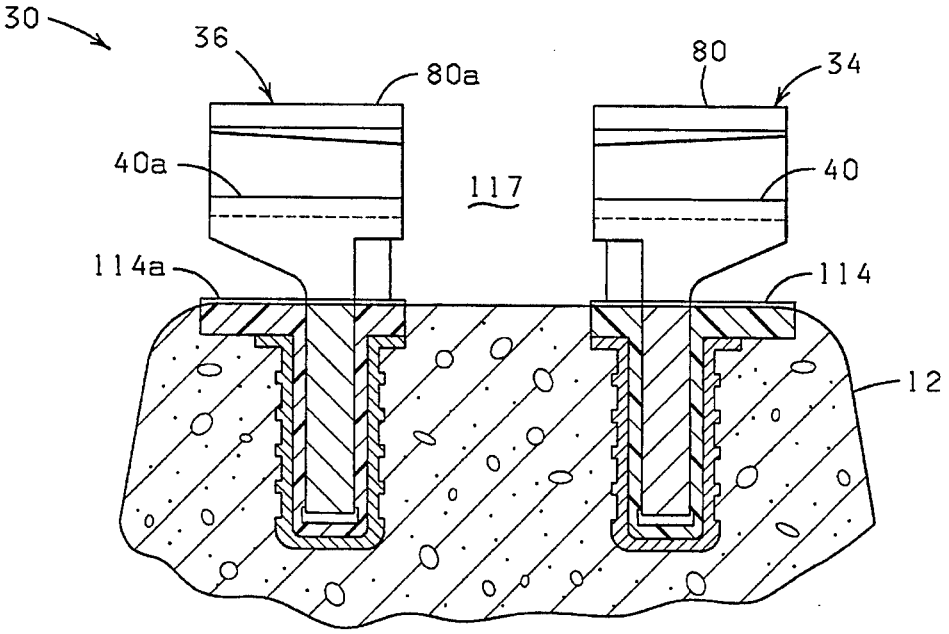
FIG. 8 is a sectional view taken at 8—8 in FIG. 7 without the rail and the rail anchor shown.

As shown in FIGS. 2 and 8, and as mentioned above, the rail seat assembly 30 includes the first rail seat subassembly 34 and the second rail seat subassembly 36 wherein the second rail seat subassembly 36 is constructed and operates exactly like the first rail seat subassembly 34 described hereinabove. Thus, the various components of the second rail seat subassembly 36 are designated in the drawings with the same reference numerals as like components of the first rail seat subassembly 34, except the various components of the second rail seat subassembly 36 also include the additional letter designation "a".

As illustrated in FIGS. 1, 7 and 8, the rail seat subassemblies 34 and 36 are each embedded in the upper surface 26 of the tie 12 such that the elastomeric tie mold plug 114 is substantially embedded in the upper surface 26 of the tie 12. The rail seat subassemblies 34 and 36 are embedded parallel to one another and spaced apart so as to form an anchor slot 117 (FIG. 2).

As shown in the drawings and as described herein above, the rail seat subassemblies 34 and 36 are two separate unconnected components. However, in another embodiment (not shown), the rail seat subassemblies 34 and 36 could be connected together. This would fix the relationship between the two rail seats 40 and 40*a* prior to embedment of the rail seat assembly 30 into the tie 12.

The rail seat subassemblies 34 and 36 are embedded into the concrete tie 12 when the tie 12 is cast. Prior to casting the tie 12, the rail seat subassemblies 34 and 36 are inserted into openings provided in the bottom of the tie mold (concrete ties are cast upside down) with the hook portions 80, 80*a* and the upper surfaces 76, 76*a* of the plate portions 68, 68*a* pointed down and below the plane of the mold bottom. The embedded portion of the rail seat subassemblies 34, 36 project upward into the mold cavity and are held in alignment with the positioning lugs 116, 116*a* formed on the edges of the tie mold plug 114, 114*a*. After the rail seat subassemblies 34, 36 have been positioned in the tie mold, formation of the concrete tie 12 proceeds in a conventional manner. While only one rail seat assembly 30 is shown herein to be embedded in the tie 12, it will be understood that the tie 12 will have a pair of oppositely disposed rail seat assemblies adapted to cooperate to hold a pair of parallel rails in proper gauge.

Referring again to FIGS. 2 and 3, the rail anchor 32 has a first end 119 and a second end 121. The rail anchor 32 includes a first tine 118 having first and second ends 120, 122, and first and second sides 124, 126. The rail anchor 32 also includes a second tine 130 having first and second ends 132, 134 and first and second sides 136, 138. The second ends 122, 134 of the respective first and second tines 118, 130 are connected together via a hook portion 140 so that the tines 118, 130 extend in generally parallel relationship and such that the first and second tines 118, 130 are capable of being deflected inwardly toward one another.

Figure 3:
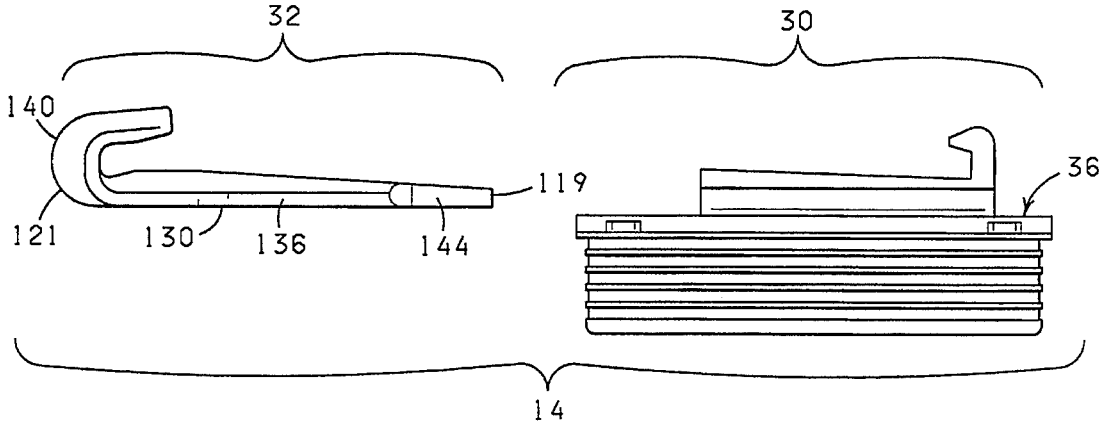
FIG. 3 is a side view of the rail-tie fastening assembly of FIG. 2.

The hook portion 140 is adapted to extend a distance generally over a portion of the upper surface 26 of the rail flange 16, generally near the second side 24 of the rail flange 16. The hook portion 140 includes one portion which connects the second end 122 of the first tine 118 to the second end 134 of the second tine 130. More particularly, as illustrated in FIGS. 2 and 3, the hook portion 140 and the first and second tines 118, 130 are integrally constructed from a single unitary piece of metallic material.

A tapered surface 142 (FIG. 2) is formed on the first side 124 of the first tine. 118. The tapered surface 142 extends a distance generally from the first end 120 toward the second end 122 of the first tine 118. A tapered surface 144 (FIG. 2) is formed on the first side 136 of the second tine 130, generally near and intersecting the first end 132 of the second tine 130. The tapered surface 144 extends a distance generally along the first side 136 generally from the first end 132 toward the second end 134. The tapered surfaces 142, 144 cooperate to provide a first end width 146 of the rail anchor 32 which is less than the width of the anchor slot 117. Thus, the first end width 146 of the rail anchor 32 is sized so that the first ends 120, 132 of the rail anchor 32 are insertable a distance into the anchor slot 117 to facilitate the insertion of the rail anchor 32 into the anchor slot 117, in a manner to be described in greater detail below.

A first seat surface 148 is formed on the first side 124 of the first tine 118, generally near the beginning of the tapered surface 142. The first seat surface 148 is spaced a distance from the first end 120 of the first tine 118. A second seat surface 150 is formed on the first side 136 of the second tine 130, generally near the beginning of the tapered surface 144. The second seat surface 150 is spaced a distance from the first end 132 of the second tine 130. The first and second seat surfaces 148, 150 cooperate to interlock the rail anchor 32 with the rail seat assembly 30 in a manner to be described below.

To fasten the rail 10 to the tie 12, the rail 10 is positioned across the rail seat assembly 30 which has been embedded in the tie 12 so as to provide the anchor slot 117. The rail 10 is positioned on the rail seat assembly 30 so that the lower surface 20 of the rail flange 16 engages the upper surface 76 of the plate portion 68 of the rail seat 40. Further, the first side 22 of the rail flange 16 generally faces and is spaced a distance from the hook portions 80, 80*a* of the rail seat subassemblies 34, 36, respectively. To complete the assembly of the rail-tie fastening assembly 14, the rail anchor 32 is positioned so that the first ends 120, 132 of the rail anchor 32 are disposed generally adjacent the anchor slot 117 with a portion of the first ends 120, 132 of the rail anchor 117 being disposed generally within a portion of the anchor slot 117 adjacent the first end 72, 72*a* of the spade portion of the rail seats 40, 40*a*.

In this position, an operator drives the rail anchor 32 into the anchor slot 117 so that the tapered portions 142, 144 engage the tapered surfaces 108, 108*a* of the tab members 106, 106*a* of the rail seats 40, 40*a* thereby forcing the first ends 120, 132 of the respective first add second tines 118, 130 generally toward each other. The operator continues to drive the rail anchor 32 into the anchor slot 117 until the tapered portions 142, 144 slide beyond the tab members 106, 106*a* and thus expand. In this expanded position or unlocked rail position, the rail anchor 32 is interlocked in the anchor slot 117 in that engagement between the seat surfaces 148, 150 and the seat surfaces 110, 110*a*, respectively, prevent the rail anchor 32 from being withdrawn from the anchor slot 117. However, it will be appreciated that the rail 10 can be freely lifted from or disposed on the rail seat assembly 30 when the rail anchor 32 is in this position with the seat surfaces 148, 150 of the first and second tines 118, 130 engaged against the seat surfaces 110, 110*a* of the tab members 106, 106*a*. Thus, it may be desirable to assemble the rail-tie fastening assembly 14 into the unlocked rail position before disposing the rail 10 onto the rail seat subassemblies 34, 36.

To secure the rail to the tie 12, the operator drives the rail anchor 32 further into the anchor slot 117 so that the tapered portions 142, 144 of the first and second tines 118, 130 engage the tapered surfaces 96, 96*a* of the spade portion 70 thereby resulting in the first and second tines 118, 130 being compressed or deflected generally toward each other as the tapered surfaces 142, 144 of the first and second tines 118, 130, respectively, slide along the tapered surfaces 96, 96*a* of the spade potion 70. In this compressed or deflected position of the rail anchor 32, the operator continues to force or drive the rail anchor 32 into the anchor slot 117 thereby moving the rail anchor 32 further through the anchor slot 117 until the tapered portions 142, 144 of the first and second tines 118, 130 are moved slightly beyond the recesses 102, 102*a* of the rail seats 40, 40*a*. The first and second tines 118, 130 then expand thereby causing the first and second tapered portions 142, 144 to expand into the recesses 102, 102*a*. In this locked rail position, engagement between the seat surfaces 148, 150 of the first and second tines 118, 130 and the seat surfaces 104, 104*a* of the rail seats 40, 40*a* cooperate to interlock the rail anchor 32 with the rail seat assembly 30.

In the locked rail position, the rail seat assembly 30 and the rail anchor 32 cooperate to secure the rail 10 to the concrete tie 12. The hook portion 140 of the rail anchor 32 engages the second side 24 of the rail flange 16 and a portion of the hook portion 140 extends over and engages a portion of the upper surface 18 of the rail flange 16. The hook portions 80, 80*a* of the rail seat assembly 30 engage the first side 22 of the rail flange 16 and a portion of the hook portions 80, 80*a* extends over and is spaced a distance above the upper surface 18 of the rail flange 16 to permit limited vertical movement of the rail 10 relative to the rail seat assembly 30. The engagement between the seat surfaces 148, 150 of the first and second tines 118, 130 and the seat surfaces 104, 104*a* of the rail seats 40, 40*a* cooperate to restrain lateral and longitudinal movement of the rail 10.

To ensure retention of the rail 10 to the concrete tie 12, the rail-tie fastening assembly 14 of the present invention effectively transfers the applied forces from the rail 10 to the tie 12. The shear spring produced by the bonding of the rail seat 40 to the rail seat basin 38 with the elastomeric material 42 in combination with the void 112 provided in the elastomeric material 42 allows for the transfer of applied vertical loads to the tie 12 through the deflection of the elastomeric material 42. The depth and length of the lower portion 78 of the spade portion 70 of the rail seat 40 and the rail seat basin 38 counteract the overturning moment produced by applied lateral loads. Finally, the flat configuration of the spade portion 70 results in longitudinal loads being effectively distributed to the tie 12 across the relatively broad, flat first and second sides 82 and 92, respectively.

Figure 9:
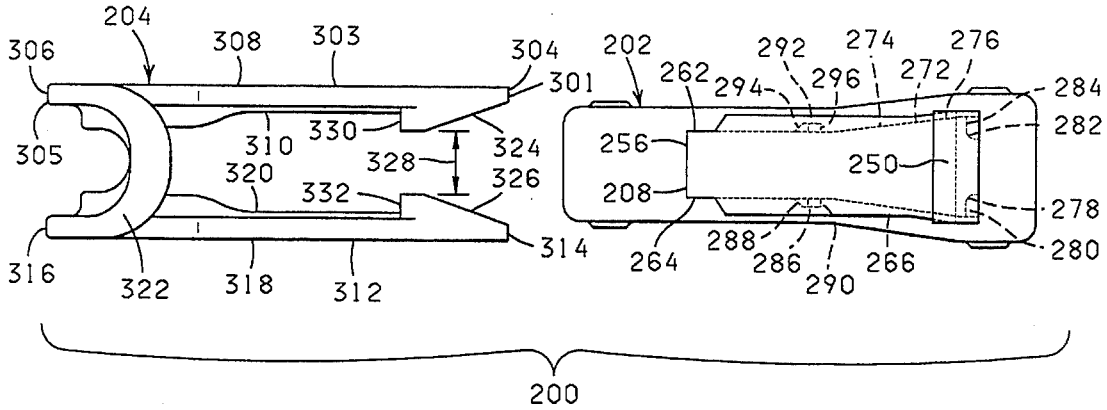
FIG. 9 is a top view of another rail-tie fastening assembly constructed in accordance with the present invention.
Figure 13:
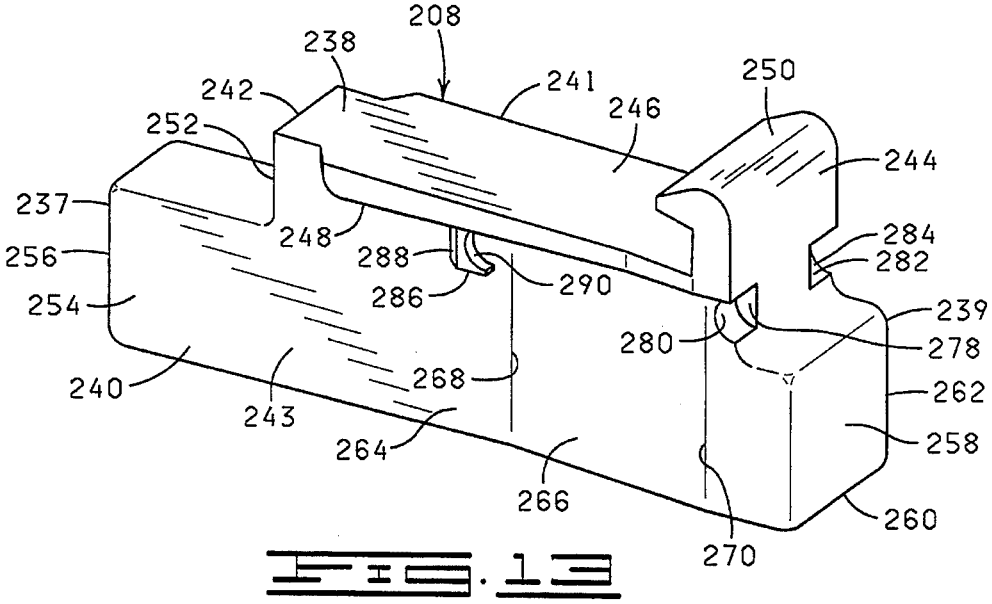
FIG. 13 is a perspective view of another rail seat.

Referring now to FIGS. 9 and 13, shown is another embodiment of a rail-tie fastening assembly 200. The rail-tie fastening assembly 200 includes a rail seat assembly 202 and a rail anchor 204.

Figure 11:
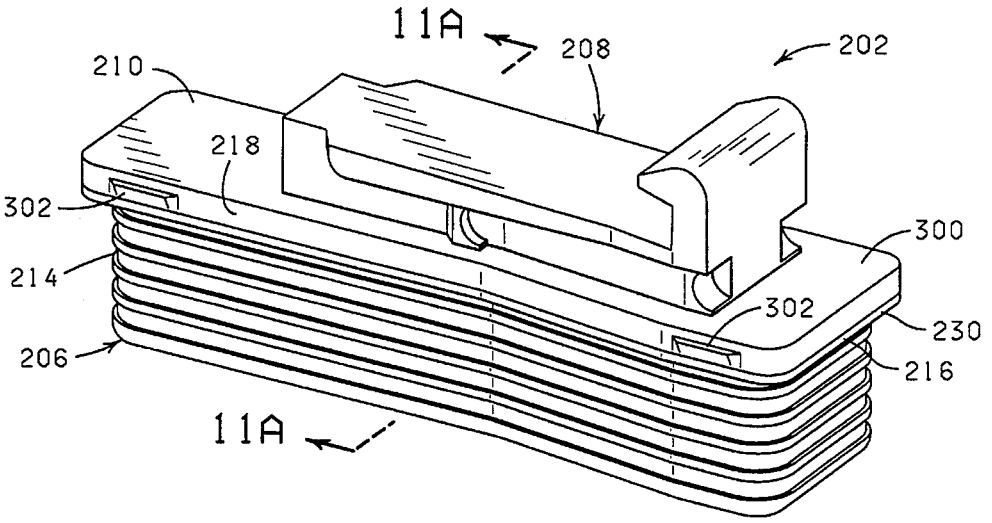
FIG. 11 is a perspective view of a rail seat assembly of the rail-tie fastening assembly of FIGS. 9 and 10.
Figure 11A:
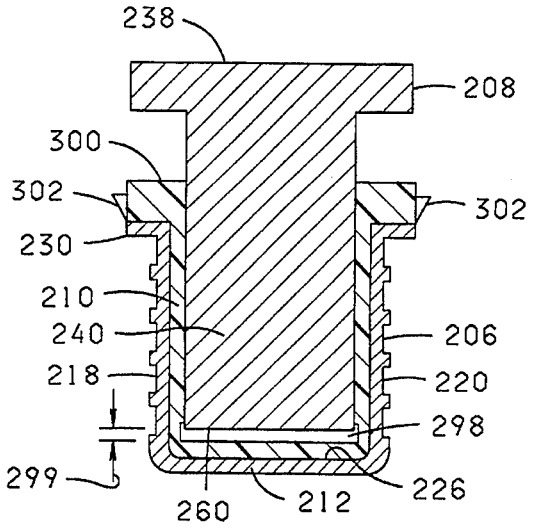
FIG. 11A is a cross sectional view taken at 11A—11A in FIG. 11.
Figure 12:
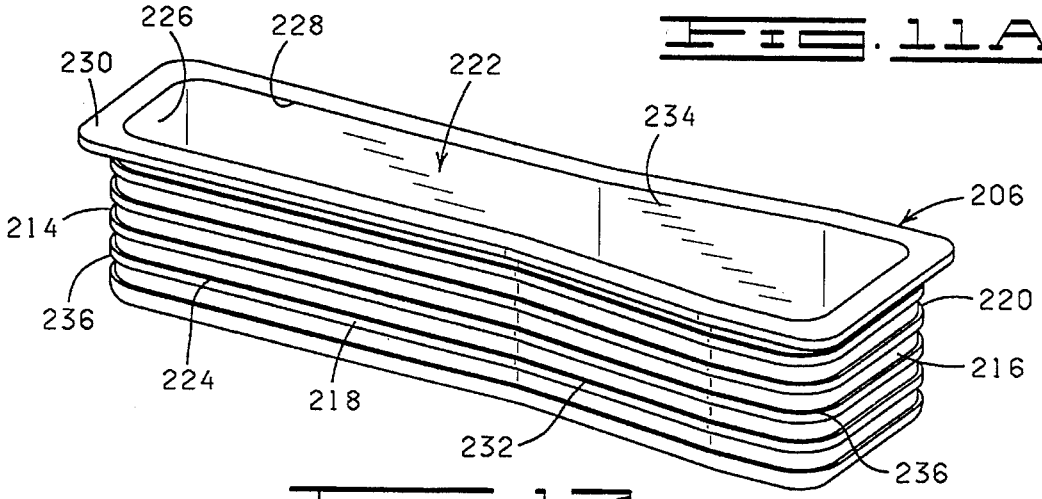
FIG. 12 is a perspective view of another rail seat basin.

In this particular embodiment, the first rail seat assembly 202 is defined as including a rail seat basin 206 and a rail seat 208 bonded to the rail seat basin with an elastomeric material 210 (FIGS. 11 and 11A). The rail seat basin 206 is adapted to be embedded in the concrete tie 12 and to receive the rail seat 208 in a manner to be described below. As best shown in FIG. 12, the rail seat basin 206 is characterized as an open container which includes a bottom end 212, a first end 214, a second end 216, a first side 218, a second side 220, all which cooperate to define a rail seat receiving cavity 222. The rail seat basin 206 further has an outer side 224, an inner side 226, an upper opening 228 providing access to the rail receiving cavity 222, and a rim 230 extending about the upper opening 228.

The rail seat receiving basin 206 may be constructed of any suitable material possessing sufficient shear and tensile strength to transfer operational loads from the rail 10 to the tie 12. These materials include ductile or gray iron, steel, die cast zinc, and various forms of plastics. A preferred material, however, is a die cast aluminum/zinc alloy.

As best shown in FIG. 12, the first side 218 and the second side 220 of the rail seat basin 206 are each provided with a tapered or angled segment 232, 234, respectively, generally near the second end 216 of the rail seat basin 206; each of which correspond to a similar portion on the rail seat as will be described hereinbelow. To enhance the union between the rail seat basin 206 and the concrete tie 12 when the rail seat basin 206 is embedded therein, the rail seat basin 206 is provided with a plurality of spaced-apart horizontal ridges 236 extending about the outer side 224 along the first and second ends 214, 216 and the first and second sides 218, 220. Further, the ridges 236 cooperate to transfer vertical loads in compression and shear at the rail seat basin/concrete interface.

Referring now to FIG. 13, the rail seat 208 is defined as having a first end 237, a second end 239, a first side 241, and a second side 243 and as including a plate portion 238 and a spade portion 240; the spade portion 240 extending downwardly from the plate portion 238. The rail seat 208 can be constructed of any suitable material such as steel, gray iron, or various plastics, but a preferred material of construction is ductile cast iron.

The plate portion 238 has a first end 242, a second end 244, an upper surface 246, and a lower surface 248. The upper surface 246 of the plate portion 238 is adapted to receive the lower portion 20 of the rail flange 16 such that the interface between the rail 10 and plate portion 238 is metal to metal when the rail seat 208 is formed from the preferred material. A hook portion 250 is formed on the second end 244 of the plate portion 238 so as to extend upwardly relative to the upper surface 246 of the plate portion 238. In a similar fashion to that illustrated in FIG. 7, the hook portion 250 is shaped and adapted to engage the second side 24 of the rail flange 16 and to extend over a portion of the upper surface 18 of the rail flange 16 generally near the second side 24 of the rail flange 16. More particularly, the hook portion 250 is shaped so that a portion of the hook portion 25 will extend over a portion of the upper surface 18 of the rail flange 16 and be spaced from the upper surface 18 of the rail flange 16 so as to permit limited vertical movement of the rail 10 relative to the rail seat 208 when the rail 10 is fastened to the tie 12 by the rail-tie fastening assembly 200 as will be discussed further hereinbelow.

The spade portion 240 extends downwardly from the lower surface 248 of the plate portion 238. The spade portion 240 includes an upper portion 252, a lower portion 254, a first end 256, a second end 258, a bottom end 260, a first side 262, and a second side 264. The lower portion 254 is elongated relative to the upper portion 252 to resist the overturning moment produced in both positive and negative directions in conjunction with an applied lateral load on the rail when the rail 10 is secured against the rail seat 208. The first and second sides 262, 264 are relatively broad, flat surfaces such that longitudinal loads applied to the rail 10 are evenly distributed to the tie 12.

The spade portion 240 is provided with a first tapered surface 266 on the second side 264 thereof generally near the second end 258 of the spade portion 240. The first tapered surface portion 266 has a first end 268 and a second end 270. The spade portion 240 is further provided with a second tapered surface portion 272 on the first side 262 thereof generally near the second end 258 of the spade portion 240. The second tapered surface portion 272 (FIG. 9) has a first end 274 and a second end 276. It will be understood that the rail seat basin 206 (FIGS. 11 and 12) is configured to substantially correspond to the configuration of the spade portion 240 so that the spade portion 240 is uniformly spaced from the inner side 226 of the rail seat basin 206 when disposed therein. A first recess 278 is formed in the upper portion 252 of the spade portion 240 on the second end 258 thereof so as to be in communication with the second side 264 of the spade portion 240. The first recess 278 is partially defined by a seat surface 280. Likewise, a second recess 282 is formed in the upper portion 252 of the spade portion 240 on the second end 258 thereof so as to be in communication with the first side 262 of the spade portion 240. The second recess 282 is partially defined by a seat surface 284.

A first tab member 286 is formed on the second side 264 of the spade portion 240 generally near the first end 268 of the first tapered surface portion 266. The first tab member 286 is provided with a tapered surface 288 and a seat surface 290; the seat surface 290 being similar in configuration to the seat surface 280 of the recess 278. A second tab member 292 (FIG. 9) is formed on the first side 262 of the spade portion 240 opposite the first tab member 286 and generally near the first end 274 of the second tapered surface portion 272. The second tab member 292 is provided with a tapered surface 294 and a seat surface 296; the seat surface 296 being similar in configuration to the seat surface 284 of the recess 282.

In assembly as shown in FIGS. 11 and 11A, the elongated lower portion 254 of the spade portion 240 of the rail seat 208 is substantially disposed within the rail seat receiving cavity 222 and aligned therein such that the spade portion 240 is uniformly spaced from the inner side 226 of the rail seat basin 206. The spade portion 240 is bonded to the inner side 226 of the rail seat basin 206 with the elastomeric material 210 such that the spade portion 240 remains uniformly spaced from the inner side 226 of the rail seat basin 206.

The elastomeric material 210 functions as a shear spring so as to transfer applied vertical and lateral load on the rail 10 to the tie 12. As mentioned above, any suitable elastomeric material can be used which possesses the characteristics of being resistant to fatigue, stable between −20° F. and +140° F., resistant to ultraviolet light and ozone, and capable of bonding the rail seat 208 to the rail seat basin 206. A preferred material is a castable polyurethane. The polyurethane is preferably polyether-based diphenylmethane diisocyanate terminated liquid pre-polymer cured with 1,4-butanediol wherein the polyether is preferably poly tetra methylene ether glycol.

To permit the rail seat 208 to move vertically downward relative to the rail seat basin 206 and to allow the elastomeric material 210 disposed adjacent the first and second ends 256, 258 and the first and second sides 262, 264 of the spade portion 240 to deflect when a load is applied to the plate portion 238, the elastomeric material 210 is provided with a void 298 between the bottom end 260 of the spade portion 240 and the bottom end 212 of the rail seat basin 206 along the inner side 226 of the rail seat basin 206 (FIG. 11A). The void 298 is formed in the elastomeric material 210 so as to be encapsulated so that air present in the void 298 after formation of the void 298 remains therein and cooperates with the elastomeric material 210 to cause the rail seat 208 to move in an up and down direction in response to loading and unloading of the rail seat 208. The void 298 is further formed to have a predetermined depth 299 so that if an overload occurs on the rail seat 208, the descending spade portion 240 fills the void 298 and engages the elastomeric material 210 disposed on the bottom end 212 of the rail seat basin 206. The elastomeric material 210 on the bottom end 212 of the rail seat basin 206 thus serves as a stop member. By preventing further deflection than that which is permitted by the elastomeric material 210 on the bottom end 212 of the rail seat basin 206, the elastomeric material 210 is prevented from being stressed beyond design limits and thus prevented from rupturing.

The void 298 is formed in the same manner as that previously described in reference to rail-tie assembly 14. Therefore, the manner of forming the void 298 will not be repeated in reference to the rail-tie fastening assembly 200.

The amount of elastomeric material 210 disposed in the rail seat basin 206 is sufficient so that when the rail seat 208 is disposed in the elastomeric material 210, a portion of the elastomeric material 210 is displaced upwardly and outwardly from the rail seat receiving cavity 222 to form a tie mold plug 300. The tie mold plug 300 is formed so that the tie mold plug 114 is wider in profile than the plate portion 68 of the rail seat 40 to allow the finished tie 12 to be extracted from the tie mold after casting. A plurality of lugs 302 are formed along the edge of the tie mold plug 300 as substantially shown to facilitate the vertical register of the rail seat assembly 202 in a tie mold (not shown). Similar to the rail seat assembly 30, the rail seat assembly 202 is embedded in the upper surface 26 of the tie 12 such that the elastomeric tie mold plug 300 is substantially embedded in the upper surface 26 of the tie 12.

Figure 10:
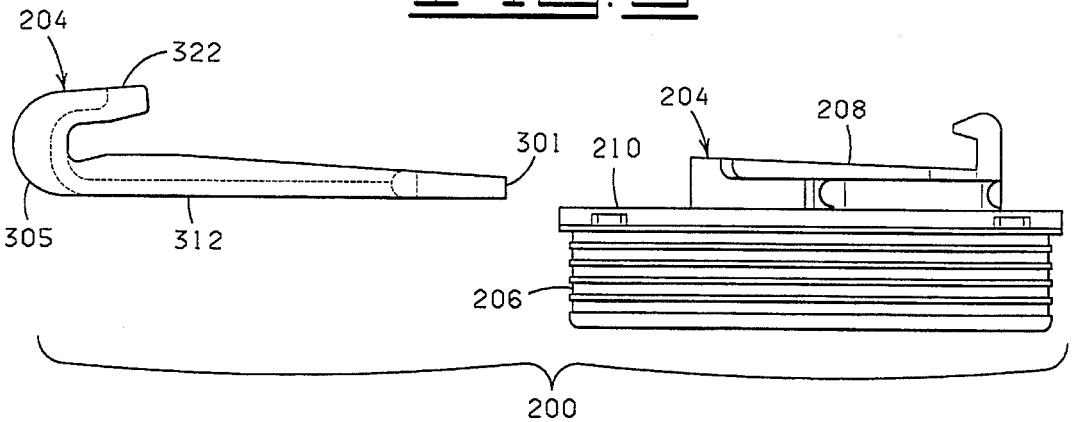
FIG. 10 is a side view of the rail-tie fastening assembly of FIG. 9.

Referring again to FIGS. 9 and 10, the rail anchor 204 has a first end 301 and a second end 305 and includes a first tine 303 having first and second ends 304, 306 and, first and second sides 308, 310. The rail anchor 204 also includes a second tine 312 having first and second ends 314, 316 and first and second sides 318, 320. The second ends 306, 316 of the respective first and second tines 303, 312 are connected together via a hook portion 322 so that the first and second tines 303, 312 extend in generally parallel relationship and such that the first and second tines 303, 312 are capable of being deflected outwardly away from one another. The hook portion 322 is adapted to extend a distance generally over a portion of the upper surface 18 of the rail flange 16, generally near the second side 24 of the rail flange 16. The hook portion 322 includes one portion which connects the second end 306 of the first tine 303 to the second end 316 of the second tine 312. More particularly, in a similar manner to that shown in FIGS. 2 and 3, the hook portion 322 and the first and second tines 303, 312 are integrally constructed from a single unitary piece of metallic material.

A tapered surface 324 (FIG. 9) is formed on the second side 310 of the first tine 303. The tapered surface 324 extends a distance generally along the second side 310 from the first end 304 toward the second end 306 of the first tine 303. A tapered surface 326 (FIG. 9) is formed on the second side 320 of the second tine 312, generally near and intersecting the first end 314 of the second tine 312. The tapered surface 326 extends a distance generally along the second side 320 generally from the first end 314 toward the second end 316.

The tapered surfaces 324, 326 cooperate to provide a first end width 328 of the rail anchor which is greater than the width of the first end 256 of the spade portion 240 of the rail seat 208. Thus, the first end width 328 is sized so that the first ends 304, 314 of the rail anchor 204 is insertable a distance onto the rail seat assembly 202 in a manner to be described in greater detail below. A first seat surface 330 is formed on the second side 310 of the first tine 303, generally near the beginning of the tapered portion 324. The first seat surface 330 is spaced a distance from the first end 304 of the first tine 303. A second seat surface 332 is formed on the second side 320 of the second tine 312, generally near the beginning of the tapered portion 326. The second seat surface 332 is spaced a distance from the first end 314 of the second tine 312. The first and second seat surfaces 330, 332 cooperate to secure the rail anchor 204 about the rail seat assembly 202 in a manner to be described in greater detail below.

To fasten the rail 10 to the tie 12, the rail 10 is positioned across the rail seat assembly 202 which has been embedded in the tie 12. The rail 10 is positioned on the rail seat assembly 202 so that the lower surface 20 of the rail flange 16 engages the upper surface 246 of the plate portion 238 of the rail seat 208. Further, the first side 22 of the rail flange 16 generally faces and is spaced a distance from the hook portion 250 of the rail seat assembly 202. To complete the assembly of the rail-tie fastening assembly 200, the rail anchor 204 is positioned so that the first ends 304 and 314 of the rail anchor 204 are disposed generally adjacent first end 256 of the upper portion 252 of the spade portion 240 of the rail seat 208 with the first tine 303 being disposed adjacent the first side 262 of the spade portion 240 and the second tine 312 being disposed adjacent the second side 264 of spade portion 240.

In this position, an operator drives the rail anchor 204 so that the tapered surfaces 324, 326 of the first and second tines 303, 312 engage the tapered surfaces 288, 294 of the tab members 286, 292, respectively, of the spade portion 240 of the rail seat 208, thereby forcing the first ends 304, 314 of the respective first and second tines 303, 312 generally away from each other. The operator continues to drive the rail anchor 204 until the tapered portions 324, 326 slide beyond the tab members 286, 292 and thus collapse. In this collapsed position or unlocked rail position, the rail anchor 204 is interlocked about the rail seat assembly 202 in that engagement between the seat surfaces 330, 332 and the seat surfaces 280, 284, respectively, prevent the rail anchor 204 from being withdrawn from the rail seat assembly 202. However, it will be appreciated that the rail 10 can be freely lifted from or disposed on the rail seat assembly 202 when the rail anchor 204 is in this position with the seat surfaces 330, 332 of the first and second tines 303, 312 engaged against the seat surfaces 290, 296 of the tab members 286, 292. Thus, it may be desirable to assemble the rail-tie fastening assembly 200 into the unlocked rail position before disposing the rail 10 onto the rail seat assembly 202.

To secure the rail to the tie 12, the operator drives the rail anchor 204 further so that the tapered surfaces 324, 326 of the first and second tines 303, 312 engage the tapered surfaces 266, 272 of the spade portion 240 thereby resulting in the first and second tines 303, 312 being expanded or deflected generally away from each other as the tapered surfaces 324, 326 of the first and second tines 303, 312, respectively, slide along the tapered surfaces 266, 272 of the spade portion 240. In this expanded or deflected position of the rail anchor 204, the operator continues to force or drive the rail anchor 204 thereby moving the rail anchor 204 until the tapered surfaces 324, 326 of the first and second tines 303, 312 are moved slightly beyond the first and second recesses 278, 282 of the rail seat 208. The first and second tines 303, 312 collapse thereby causing the first and second tapered portions 324, 326 to fall into the respective first and second recesses 278, 282. In this locked rail position, engagement between the seat surfaces 330, 332 of the first and second tines 303, 312 and the seat surfaces 280, 284 of the rail seat 208 cooperate to secure the rail anchor 204 to the rail seat assembly 202 and thereby secure the rail 10 to the concrete tie 12.

While the present invention has been described in reference to connecting railroad rails to concrete ties, it will be appreciated that the present invention is not limited to connecting railroad rails to concrete ties in that the inventive concept is applicable to any system wherein an element or member is to be anchored to a support member or structure. For example, the rail tie fastening assembly of the present invention can be used to effectively fasten a rail to a tie formed of a variety of other materials such as wood, steel or a composite material. Furthermore, it will be appreciated that the rail tie fastening assembly of the present invention is not limited to use with railroads but can also be used other rail systems such a monorails.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A method for forming a rail-tie fastening assembly adapted for cooperating to fasten a rail to a support structure, the rail having a rail flange with a lower surface, the method comprising the steps of:

providing a rail seat having a plate portion and a spade portion, the plate portion adapted to receive the lower portion of the rail flange, the spade portion extending downwardly from the plate portion and having a bottom end;

disposing at least a portion of the spade portion of the rail seat into the support structure;

bonding the spade portion of the rail seat to the support structure with an elastomeric material such that the spade portion of the rail seat is spaced apart from the support structure; and providing the elastomeric material with a void near the bottom end of the spade portion to permit the rail seat to move vertically downward relative to the support structure when a load is applied to the rail seat.

2. The method of claim 1 wherein the support structure is a tie.

3. The method of claim 1 wherein the support structure is a concrete tie.

4. A method for forming a rail-tie fastening assembly adapted for cooperating to fasten a rail to a support structure, the rail having a rail flange with a lower surface, the method comprising the steps of:

providing a rail seat having a plate portion and a spade portion, the plate portion adapted to receive the lower portion of the rail flange, the spade portion extending downwardly from the plate portion and having a bottom end;

disposing at least a portion of the spade portion of the rail seat into a rail seat basin, the rail seat basin having a bottom end, an outer side, and an inner side, the inner side defining a rail seat receiving cavity;

bonding the spade portion of the rail seat to the inner side of the rail seat basin with an elastomeric material such that the spade portion of the rail seat is spaced apart from the inner side of the rail seat basin;

providing the elastomeric material with a void near the bottom end of the spade portion to permit the rail seat to move vertically downward relative to the support structure when a load is applied to the rail seat; and embedding the rail seat basin into the support structure.

5. The method of claim 4 wherein the support structure is a tie.

6. The method of claim 4 wherein the support structure is a concrete tie.

7. A method for forming a rail-tie fastening assembly adapted for cooperating to fasten a rail to a support structure, the rail having a rail flange with an upper surface, a lower surface, a first side, and a second side, the method comprising the steps of:

providing a rail seat having a plate portion and a spade portion, the plate portion having a first end and a second end, the plate portion adapted to receive the lower portion of the rail flange and the plate portion having a hook portion extending from near the first end of the rail seat adapted to extend about the first side of the rail flange and a portion of the upper surface of the rail flange, the spade portion extending downwardly from the plate portion and having a bottom end;

disposing at least a portion of the spade portion of the rail seat into a rail seat basin, the rail seat basin having a bottom end, an outer side, and an inner side, the inner side defining a rail seat receiving cavity;

bonding the spade portion of the rail seat to the inner side of the rail seat basin with an elastomeric material such that the spade portion of the rail seat is spaced apart from the inner side of the rail seat basin;

providing the elastomeric material with a void near the bottom end of the spade portion to permit the rail seat to move vertically downward relative to the support structure when a load is applied to the rail seat; and embedding the rail seat basin into the support structure.

8. The method of claim 7 wherein the support structure is a tie.

9. The method of claim 7 wherein the support structure is a concrete tie.

10. A method for forming a rail-tie fastening assembly adapted for cooperating to fasten a rail to a support structure, the rail having a rail flange with an upper surface, a lower surface, a first side, and a second side, the method comprising the steps of:

providing a first rail seat and a second rail seat, the first rail seat and the second rail seat each having a plate portion and a spade portion, the plate portion having a first end and a second end, the plate portion adapted to receive the lower portion of the rail flange and the plate portion having a hook portion extending from near the first end of the rail seat adapted to extend about the first side of the rail flange and a portion of the upper surface of the rail flange, the spade portion extending downwardly from the plate portion and having a bottom end;

disposing at least a portion of the spade portion of the first rail seat into a first rail seat basin, the first rail seat basin having a bottom end, an outer side, and an inner side, the inner side defining a rail seat receiving cavity;

disposing at least a portion of the spade portion of the second rail seat into a second rail seat basin, the second rail seat basin having a bottom end, an outer side, and an inner side, the inner side defining a rail seat receiving cavity;

bonding the spade portion of the first rail seat to the inner side of the first rail seat basin with an elastomeric material such that the spade portion of the first rail seat is spaced apart from the inner side of the first rail seat basin;

bonding the spade portion of the second rail seat to the inner side of the second rail seat basin with an elastomeric material such that the spade portion of the second rail seat is spaced apart from the inner side of the second rail seat basin;

providing the elastomeric material bonding the first rail seat to the first rail seat basin with a void near the bottom end of the spade portion of the first rail seat to permit the first rail seat to move vertically downward relative to the support structure when a load is applied to the first rail seat;

providing the elastomeric material bonding the second rail seat to the second rail seat basin with a void near the bottom end of the spade portion of the second rail seat to permit the second rail seat to move vertically downward relative to the support structure when a load is applied to the second rail seat; and embedding the first and second rail seat basins into the support structure in a spaced apart, parallel relationship.

11. The method of claim 10 wherein the support structure is a tie.

12. The method of claim 10 wherein the support structure is a concrete tie.

* * * * *

Disclaimer and Dedication 5,494,212—S. Hudson Owen, Marshfield, Wis. RAIL-TIE FASTENING METHOD FOR CONCRETE TIE. Patent dated Feb 27, 1996. Disclaimer and dedication filed Apr. 30, 2003, by the assignee, Kerr-McGee Chemical LLC.

Hereby disclaims and dedicates to the Public, the remaining term of said patent.

*(Official Gazette, July 15, 2003)*